US012644384B2

(12) United States Patent
Grief et al.

(10) Patent No.: US 12,644,384 B2
(45) Date of Patent: Jun. 2, 2026

(54) WEAR PROTECTION CAP AND A BIT HOLDER ARRANGEMENT

(71) Applicant: SANDVIK MINING AND CONSTRUCTION G.M.B.H., Zeltweg (AT)

(72) Inventors: Ralf Grief, Zeltweg (AT); Christian Schrunner, Zeltweg (AT)

(73) Assignee: Sandvik Mining and Construction G.m.b.H., Zeltweg (AT)

( * ) Notice: Subject to any disclaimer, the term of this patent is extended or adjusted under 35 U.S.C. 154(b) by 204 days.

(21) Appl. No.: 18/719,433

(22) PCT Filed: Dec. 16, 2022

(86) PCT No.: PCT/EP2022/086462

§ 371 (c)(1),
(2) Date: Jun. 13, 2024

(87) PCT Pub. No.: WO2023/111319

PCT Pub. Date: Jun. 22, 2023

(65) Prior Publication Data

US 2025/0052155 A1 Feb. 13, 2025

(30) Foreign Application Priority Data

Dec. 17, 2021 (EP) ..... 21215580

(51) Int. Cl.
*E21C 35/183* (2006.01)

(52) U.S. Cl.
CPC ..... *E21C 35/1837* (2020.05); *E21C 35/1831* (2020.05)

(58) Field of Classification Search
CPC ..... E21C 35/1837; E21C 35/1831
See application file for complete search history.

(56) References Cited

U.S. PATENT DOCUMENTS

| | | | | |
|---|---|---|---|---|
| 3,856,359 | A * | 12/1974 | Krekeler | E21C 35/1933 37/457 |
| 9,782,889 | B2 * | 10/2017 | Lemmey | B25H 3/003 |
| 2021/0062652 | A1 | 3/2021 | Geyer et al. | |

FOREIGN PATENT DOCUMENTS

| | | | |
|---|---|---|---|
| CN | 108825231 | A | 11/2018 |
| DE | 3931838 | A1 | 4/1991 |
| DE | 19922206 | A1 | 11/2000 |
| DE | 102012101732 | A1 | 9/2012 |
| DE | 102014112539 | A1 | 3/2016 |
| WO | 2012155163 | A2 | 11/2012 |
| WO | 2016071001 | A1 | 5/2016 |

* cited by examiner

*Primary Examiner* — Janine M Kreck
(74) *Attorney, Agent, or Firm* — Corinne R. Gorski

(57) ABSTRACT

A wear resistant cap securable to a surface of a bit holder is provided. The wear resistant cap includes a top panel and a side panel. The top panel has a peripheral section enclosing an opening. The forward extension of the top panel, or together with an extension of a side wall at the front, is larger than the rearward extension the top panel. A bit holder arrangement is also provided. The bit holder arrangement includes a bit holder and a wear resistant cap releasably attached to the upper surface of the bit holder.

13 Claims, 12 Drawing Sheets

WEAR PROTECTION CAP AND A BIT HOLDER ARRANGEMENT

RELATED APPLICATION DATA

This application is a § 371 National Stage Application of PCT International Application No. PCT/EP2022/086462 filed Dec. 16, 2022 with priority to EP Application Serial No. 21215580.8, filed Dec. 17, 2021.

FIELD OF INVENTION

The present invention relates to wear protection for a bit holder, and in particular, although not exclusively, to a wear resistant cap applied on a bit holder for a mining machine.

BACKGROUND ART

To protect a bit holder from abrasive wear, hard material segments are welded on the surface of a bit holder to form a pattern of a grid as shown in FIG. 16.

DE3931838 describes a bit holder 2 carrying a bit body 9 for a mining machine. It is seen from its FIGS. 1 and 3 that the front portion of bit holder 2 is not covered by protection cap 4 and not protected from wear; further, the protection cap 4 lacks a fixing function at the front portion of bit holder, thus it may fall off from the rear side in the absence of grippers 6 at the rear end.

DE102012101732 describes a polygonal shaped shield washer for mounting on a pick holder having a mating polygonal shaped barrel, the washer including a top having an interior opening and outer periphery defined by plurality of edges, each pair of adjacent edges being joined at a corner, and a skirt extending rearwardly from the outer periphery of the top, the skirt having a plurality of edges and corners aligned with the edges and corners of the top.

SUMMARY OF THE INVENTION

It is known that a cutting bit or pick is to be replaced by a new one once worn-out, this can be completed in the mine site. However, it is more troublesome and time consuming when the bit holder is also worn out, i.e., there is a need to replace the bit holder as well, for doing this, the cutting drum has to be brought to a maintenance factory, this increases the machine shut down time. To ensure a longer life cycle of a bit holder it makes sense to protect it from abrasive wear.

A bit holder in use is usually directly fixed onto a cutting drum, this means it is secured to a cutting drum without any intermediate structure, for example rigidly welded directly onto the cutting drum and is usually not releasable from the cutting drum unless with undue effort.

It is an objective of the present application to provide a full and all-around wear resistance protection to such bit holder.

It is a further objective of the present application to provide a bit holder arrangement that enables the exchange of the wear resistant cap without demounting a bit holder, as an economical solution.

The bit holder arrangement allows easy maintenance, it includes a wear resistant cap that is designed to be form-fit with the outside contour of an upper part of the bit holder. The wear resistant cap is releasable and simply fixed to the bit holder using an adhesive, without any special bolting or other fastening means. All the directional forces from the outside acting on the surface of the wear resistant cap will not be able to take the cap apart from the bit holder.

According to a first aspect of the present application, there is provided a wear resistant cap that is securable to a surface of a bit holder, wherein the bit holder is configured to receive a cutting tool (e.g. a cutting bit, or a cutting bit together with a sleeve), the wear resistant cap comprising a top panel and a side panel connected or joined to the top panel; wherein the top panel is configured to cover a top surface of the bit holder, the top panel comprises a peripheral section enclosing an opening that is configured to receive the cutting tool; wherein the side panel comprises at least one side wall connected or joined to the out edge of the top panel, and configured to cover at least a portion of the side surface of bit holder; the top panel comprises a forward extending portion having a forward extension e1 and a rearward extending portion having a rearward extension e2, said extension e1, e2 is defined as a length measured from an inner edge of the peripheral section to the forward or rearward edge of the top panel respectively, wherein the forward extension e1 or together with an extension e3 of a side wall at the front is larger than the rearward extension e2, said extension e3 of the side wall is defined as a length measured from the top edge to the bottom edge of the side wall. Keeping e1 being larger than e2 ensures that a front portion of the bit holder is protected from wear. Optionally, said extension e1, e2 may be defined as a length measured from the centre of the opening to the forward or rearward edge of the top panel respectively.

The forward or front direction is defined as towards a direction of cutting or movement direction of the bit holder (also shown in FIG. 5). The forward and rearward extension is measured along the central axis of the top panel, which is axis of symmetry of the top panel, shown in FIG. 1 as axis x. The central axis passes through the center of the opening.

The top panel may extend from the opening in radial direction in a range of up to 360 degree. The opening is preferably of circular form. The top panel has a forward edge in line segment that is perpendicular to the central axis of the top panel. The top panel may have a rearward edge in line segment that is perpendicular to the central axis of the top panel or in a curve. Therefore, the forward portion of the top panel is substantially of U-form, the rear portion of the top panel is of half circular form or is substantially of inversed U-form.

The side panel is tilted/angled downwardly in relation to the top panel. The extension of a side wall is the length of intersection line derived from the side wall intersecting with a cutting plane that is through the normal line (or axis z, shown in FIG. 5) of the top panel at the centre of the opening. Preferably, the side wall has substantially the same extension in length. Said extension e3 of the side wall is the length of the intersection line which is coplanar with the central axis of the top panel.

The opening of the cap can be a close fit on a shoulder of the cutting tool, or close fit to a sleeve shank.

A side panel is understood as a curved shell surrounding the side surface of the bit holder, the wear resistant cap may include a part of side panel situated in the front configured to cover the front surface of the bit holder, the top panel leading downwardly into the front part of side panel. Preferably, the side panel includes a plurality of axially adjacent side walls joining in sequence via lateral edges to form a continuous side protection and forming a surrounding closed wall. Preferably, the side panel includes at least one curved side wall.

The wear resistant cap substantially adapts to the shape/form of the bit holder, and is form fit with the bit holder, so as to be rotation-locked or secured on the bit holder, therefore it needs no special flat support surfaces from a bit holder to rest on.

In one embodiment, the wear resistant cap is seen as trumpet-like circumferential enclosure around the bit holder (e.g., as shown in FIGS. 1 to 3); optionally, the cap's side panel can be an enclosure from the rear and both sides, and leaving the front free/open (e.g., as shown in FIGS. 8 to 10; and FIGS. 12 to 14), thus it can be mounted on and removed from the top of a bit holder.

In one embodiment, the wear resistant cap is understood as a mantle that is in form of convex curved surface, configured to cover at least a part of surface of the bit holder, it comprises a peripheral section enclosing an opening that is configured to receive a cutting tool, the wear resistant cap is formed such that:

a plane section, which is an intersection of a cutting plane with the surface of the cap, constitutes two curves separated by the opening wherein said cutting plane is a plane through the normal line of the top panel at the centre of the opening, wherein the rectified lengths of said two curves are in substantial same scale in size, preferably larger than the radius of the opening. More preferably the rectified lengths are at least 1.5 times as large as the radius of the opening. Said cutting plane may pass through any of the top panel's radial lines starting from the centre of the opening.

It is understood that, when rectified, a curve gives a straight-line segment with the same length as the curve's arc length.

Preferably the top panel comprises a front portion extending forward beyond the peripheral section, in a generally rectangular or U form with its inner starting edge in an arc form joining the peripheral section. This allows that the top panel covers a part of a base portion of the bit holder. Optionally, such front portion is tapered inwardly as it extends toward the forward edge of the top panel, said front portion can be a generally flat shoulder. Optionally, said front portion may protrude in relation to the plane of the peripheral section.

In one embodiment, the forward extension e1 or together with an extension e3 of a side wall at the front is at least twice as large as the rearward extension e2. The side wall at the front may preferably include an opening, this opening corresponds, in position and diameter, to a channel in a bit holder for passage of fluid.

In one embodiment, the side wall at the rearward is tapered/angled inwardly or outwardly in a direction towards the top panel.

Preferably, the peripheral section has a thickness smaller than the thickness of the rest of the top panel. This recess formed in the peripheral section leaves space for accommodating a part of a sleeve or a cutting bit.

The wear resistant cap may have uniform thickness. Preferably, at least a part of the side panel, for example the side wall at the rearward and/or at the left side and/or at the right side, has an enlarged thickness than the rest of the wear resistant cap, for example larger than the thickness of the top panel. Optionally, the enlarged thickness is formed by using additional layer of wear resistant material. Optionally, said additional layer may be made of a material which is even more wear resistant than the material of the side panel at the base. The enlarged thickness ensures enhanced wear protection to that area.

The wear resistant cap is preferably made of a material that is more wear resistant than the material of the bit holder, it may be made of the same material as the bit holder.

Preferably, at least a part of the side panel, for example the side wall at the rearward and/or at the left side and/or at the right side, includes bulging ribs, preferably arranged in a grid form. The bulging ribs may be made of the same material as the material of the side panel at the base, optionally the bulging ribs may be made of a material which is even more wear resistant than the material of the side panel at the base. The bulging ribs in hard material ensure enhanced wear protection to that area.

Preferably, the top panel and the side panel are formed as one integral part; preferably the peripheral section includes a circular ring or a closed circumferential ring starting in radial direction from the opening. This is to provide immediate protection in radial direction to the area surrounding the cutting tool, and to ensure that no surface portion of the bit holder is exposed from top.

Preferably, the wear resistant cap comprises a transitional segment situated between the top panel and the side panel, the transitional segment leading/connecting the top panel into the side panel; it may be a bevel.

Preferably, the side panel extends to a desired length corresponding to a permissible wear distance or target wear distance (s, as shown in FIG. 3), preferably the desired length is not less than the radius of the opening.

Optionally, the front portion includes a protrusion in relation to the rear portion of the top panel. This aims to adapt to the form/shape of the bit holder.

Optionally, the side wall at the rearward is tapered/angled inwardly or outwardly in a direction towards the top panel. Herein the wording "tapered/angled inwardly" means, it become successively smaller in cross-section in a direction towards the top panel.

The wear resistant cap is made by deep drawing, it is not necessarily be hot formed but may be hot formed.

According to a second aspect of the present application, there is provided a bit holder arrangement for supporting a cutting tool, the bit holder arrangement is securable on a cutter drum of an underground mining machine, comprising:

a bit holder, which comprising a base portion and a bit mounting portion (or sleeve mounting portion when a sleeve is used) located above the base portion; wherein the base portion having a bottom surface that is configured to be fastenable on the cutter drum; wherein the bit mounting portion (or sleeve mounting portion when a sleeve is used) includes a bore or a generally cylindrical bit receptacle for receiving the cutting tool (e.g. for the passage of the cutting tool shaft), wherein the central axial axis of the bore or receptacle tilts forward and/or forms an acute angle in relation to the bottom surface; wherein the bit holder comprises a top surface from which the bore extends, and a side surface that extends between the bottom surface and the top surface;

the bit holder arrangement further comprising a wear resistant cap attachable to the bit holder which is a wear resistant cap according to any preceding embodiment, said wear resistant cap is configured to cover the top surface and at least a part of the side surface.

It is noted that a wear resistant cap is form-fit with the outside contour of an upper part of the bit holder, so that when said wear resistant cap is applied onto the bit holder, the centre of the opening of the top panel corresponds to and aligns with the centre of the bore of the bit mounting portion, and the diameter of said opening is equal to or larger than the diameter of said bore.

Preferably, the wear resistant cap is releasably attached to the bit holder, preferably in terms of an adhesive material. The cap needs no additional bolts or screws to fasten it.

The present application is partly based on the bit holder design as described in WO2012155163, thus the entire document of WO2012155163 is incorporated herein by reference.

BRIEF DESCRIPTION OF DRAWINGS

A specific implementation of the present application will now be described, by way of example only, and with reference to the accompanying drawings in which.

DETAILED DESCRIPTION OF PREFERRED EMBODIMENT OF THE INVENTION

Figure 1:
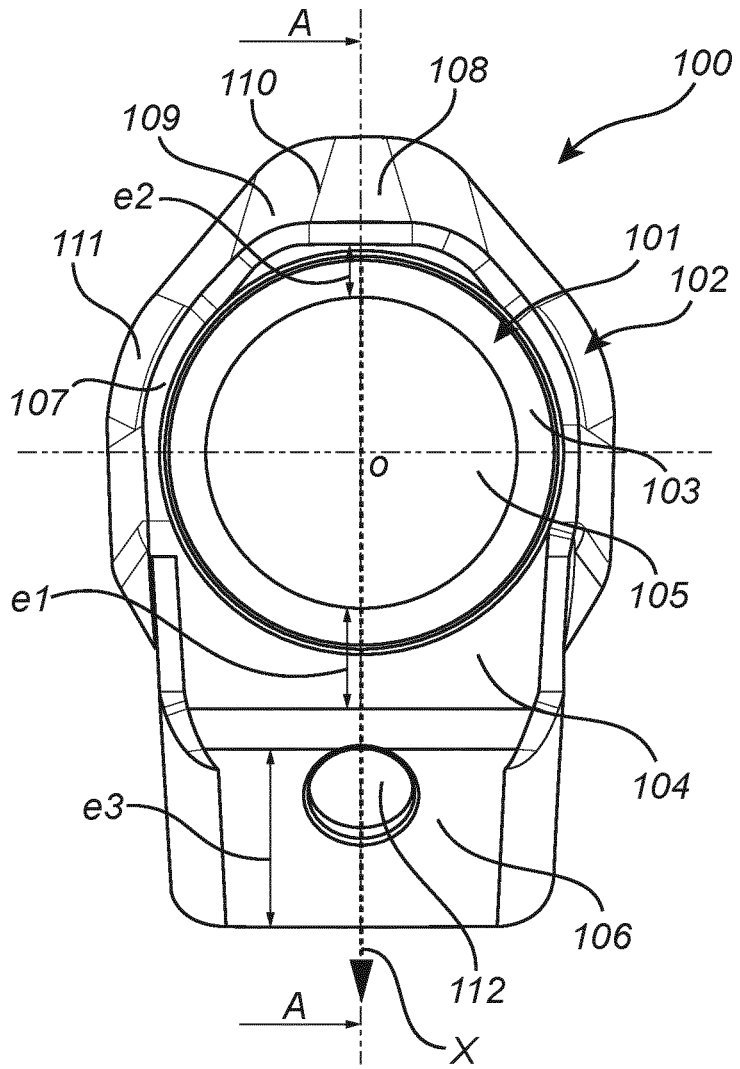
FIG. 1 is a top view of a wear resistant cap, according to a specific implementation of the present application.
Figure 2:
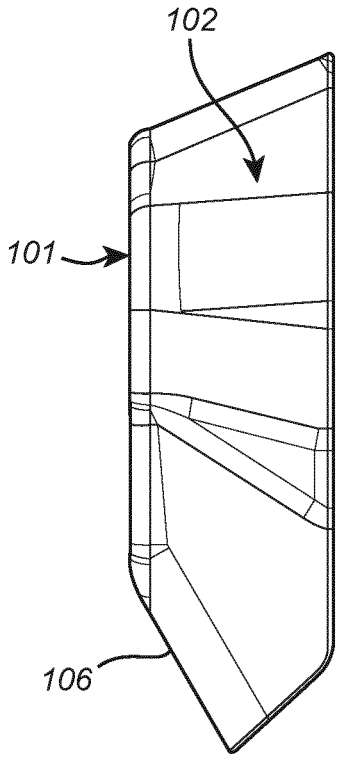
FIG. 2 is a side elevation view of the wear resistant cap of FIG. 1.
Figure 3:
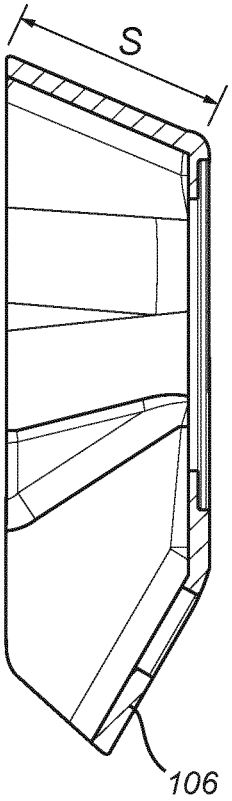
FIG. 3 is a cross-section view of the wear resistant cap of FIG. 1 along cross-section A-A of FIG. 1.

Referring to FIGS. 1, 2 and 3, a wear resistant cap 100 is shown in top view (seen along axis z), side elevation view and cross-section view along cross-section A-A, respectively. The cross section A-A passes through the center of the opening 105 of the top panel 101.

The wear resistant cap is in substantially trumpet-like form and tapered toward the top panel 101.

The wear resistant cap 100 comprises a top panel 101 and a side panel 102 connected/joined to the top panel; the top panel 101 comprises a peripheral section 103 enclosing an opening 105, the peripheral section 103 has a form of a circumferential ring starting in radial direction immediately from the opening 105, to ensure that no surface portion of the bit holder is exposed from top.

The side panel 102 comprises a plurality of side walls 106, 108, 109, 111 connected/joined to the outer edge of the top panel, optionally via a transitional segment 107 which is in a form of a bevel; the side walls 106, 108, 109, 111 may be planar or curved plates, for example side wall 108 is concatenated to adjacent side wall 109 at lateral edge 110, in this way the plurality of side walls joining in sequence to form a continuous side protection and form a surrounding closed wall, and configured to cover at least a top portion of the side surface 402 of bit holder. In this embodiment, some side walls like 109, 111 are in curved form.

The top panel comprises a front portion 104, 801, 1201 extending forward beyond the peripheral section 103 in a generally rectangular or U form with its starting edge in an arc form joining the peripheral section 103.

The top panel 101 comprises a forward extending portion having a forward extension e1 and a rearward extending portion having a rearward extension e2, said extension is measured from an inner edge of the peripheral section (103) to the forward or rearward edge of the top panel 101 respectively. The extension e3 of a side wall is defined as a length from the upper edge to the bottom edge of the side wall. In particular, it is the length of intersection line of the side wall intersecting with a cutting plane that is through the normal line of the top panel at the center of the opening 105. In this example, the side wall is around 5 mm thick and 50 mm high adapted for a tool shaft having a diameter of 60 mm.

It is seen that the forward extension e1 together with an extension e3 of a side wall at the front is larger than the rearward extension e2. The side wall at the front includes an opening 112, this opening corresponds, in position and diameter, to a channel 408 in a bit holder 400 for passage of fluid.

The wear resistant cap 100 is made of a hard material, it is more wear resistant than the material of the bit holder, for example, the cap may be in manganese steel, hardened steel, white iron, or cemented carbide such as HX900. The body of wear resistant cap 100 is made by deep drawing, it is not necessarily be hot formed but may be hot formed.

Figure 4:
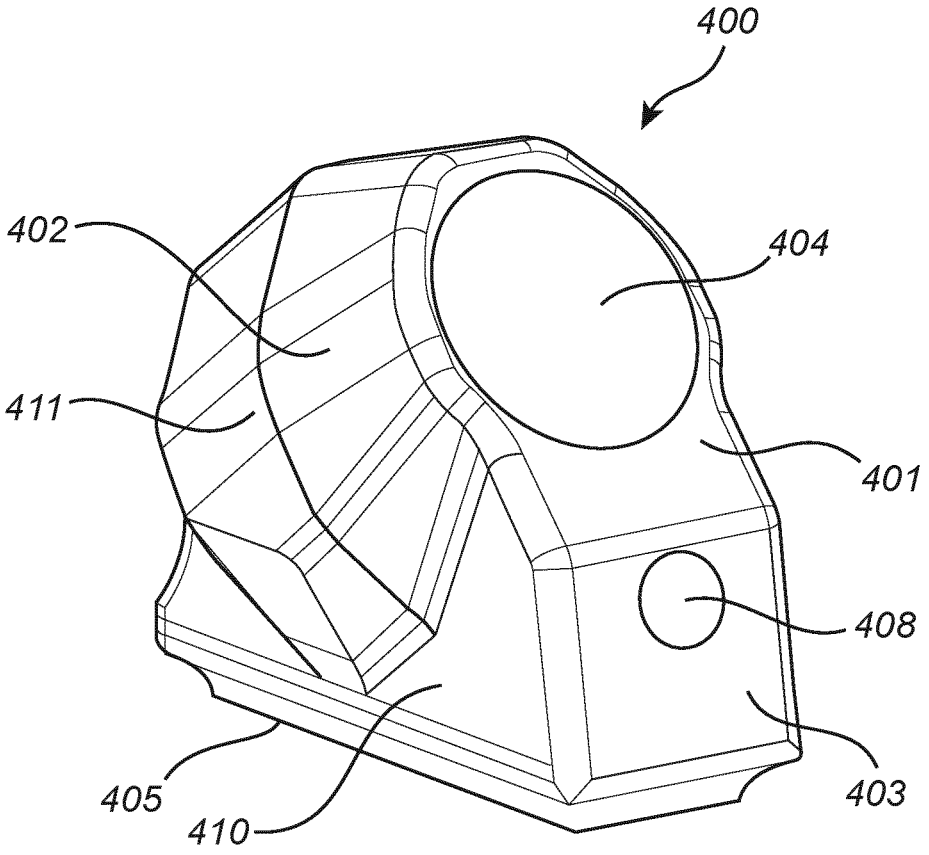
FIG. 4 is perspective view of a bit holder in accordance with one embodiment of the present application.
Figure 5:
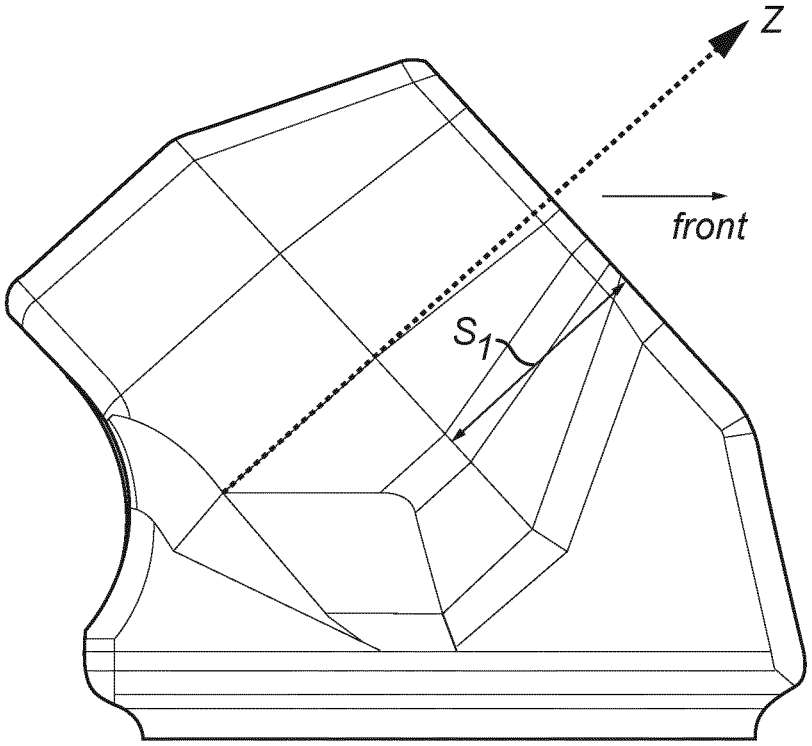
FIG. 5 is a side elevation view of a bit holder of FIG. 4.

In FIGS. 4 and 5, a bit holder is designated by 400, which includes a bore 404 defined by a bore surrounding wall, in which a cutting bit is lead into and is held therein. It has outer flat periphery surface 401, the bit holder 400 can be fixed via bottom surface 405, by means not represented in greater detail, for example, to a cutting roller.

The bit holder 400 includes a base portion 410 and a bit/sleeve mounting portion 411 located above and supported by the base portion, the bit/sleeve mounting portion includes a surrounding wall to form a generally cylindrical bore which is forward and upward angled/tilted in about 40-60 degree for receiving a cutting bit or sleeve. The bit mounting portion has a top face 401 which is substantially flat, has a forward extension e1. The axial protection depth $s_1$ is at least 40 mm (see FIG. 5).

The side surface 403 in the front includes a channel 408 for the supply of pressurized fluid (e.g., oil, water, or oil emulsion, or other fluid), the fluid applies a force against the rear end of the cutting bit or sleeve shank, moving it axially towards the open end, so as to urge a cutting bit or sleeve shank out of the bore 404.

When it becomes necessary to replace the wear resistant cap, take out the cutting bit or sleeve shank first either manually or by supply of pressurized fluid, and then remove the cap by overcoming the bonding force of the adhesive.

The bit holder is made of steel, or manganese steel, or chromium molybdenum steel, the wear resistant cap that is releasably attached onto the top panel and upper part of side panel of the bit holder. In the embodiment of FIGS. 1 to 3, the side panel 102 is shown to consist of multiple pieces of wear plates 106, 108, 109 and 111 arranged side by side. The wear resistant cap extends about 50 mm in height from upper edge to lower edge, and 5 mm in thickness.

Figure 6:
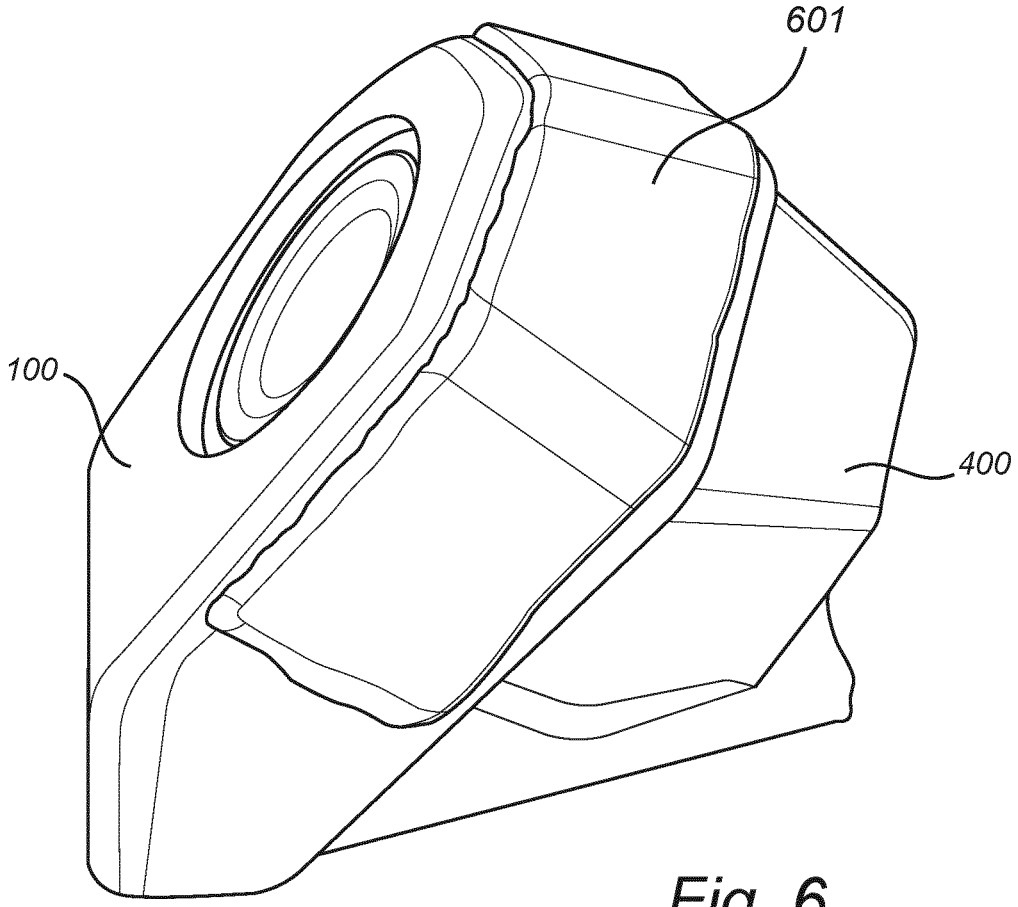
FIG. 6 shows a perspective view of a bit holder arrangement having a wear resistant cap in accordance with another embodiment of the present application.

FIG. 6 shows a bit holder arrangement having a wear resistant cap, the wear resistant cap is a variant of a wear resistant cap of the embodiment in FIGS. 1 to 3, wherein the cap has similar design as in FIGS. 1 to 3, except that it has an enlarged thickness in a part 601 of the side wall at the rearward and at the left side and at the right side. Part 601 is the applied wear resistant surface.

Figure 7:
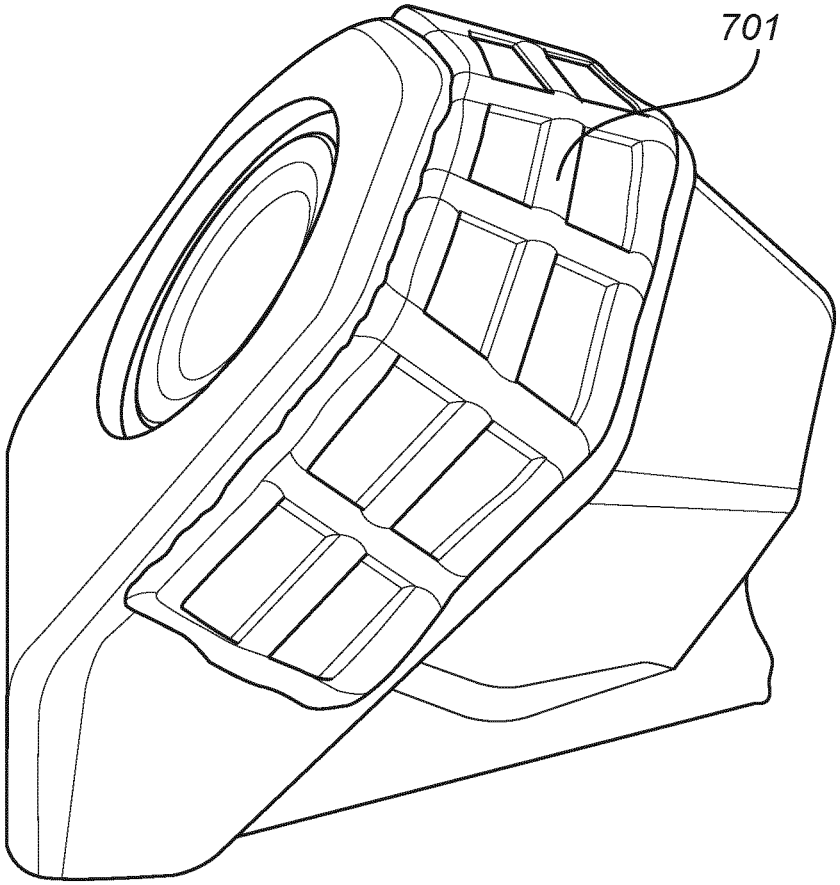
FIG. 7 shows a perspective view of a bit holder arrangement having a wear resistant cap in accordance with a further embodiment of the present application.

FIG. 7 illustrates a further bit holder arrangement having a wear resistant cap, the wear resistant cap is a further variant of a wear resistant cap of the embodiment in FIGS. 1 to 3, wherein the cap has similar design as in FIGS. 1 to 3, except that it includes bulging ribs 701 in a grid form in a part of the side wall at the rearward and at the left side and at the right side. Part 701 is the applied wear resistant grid.

Figure 8:
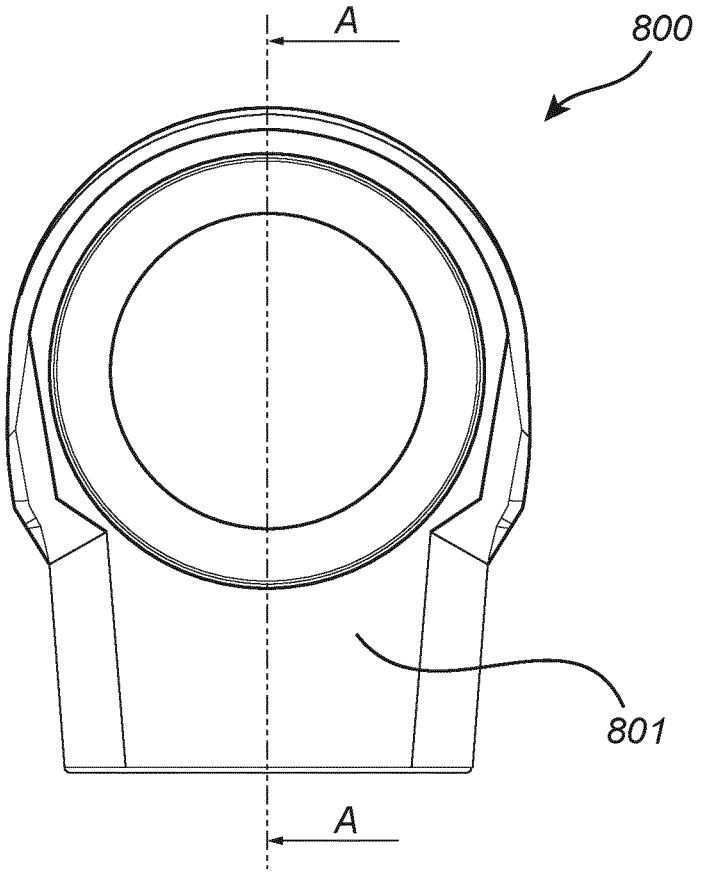
FIG. 8 is a top view of a wear resistant cap, according to a specific implementation of the present application.
Figure 9:
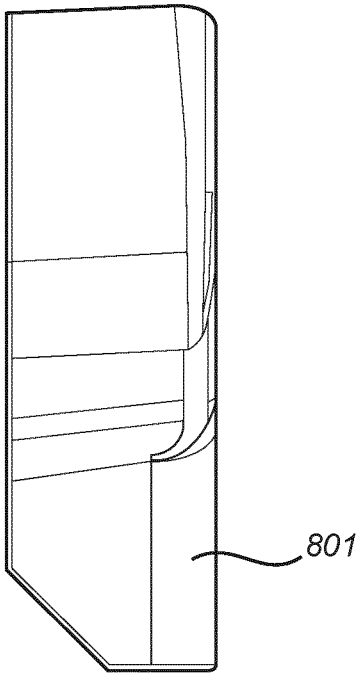
FIG. 9 is a side elevation view of the wear resistant cap of FIG. 8.
Figure 10:
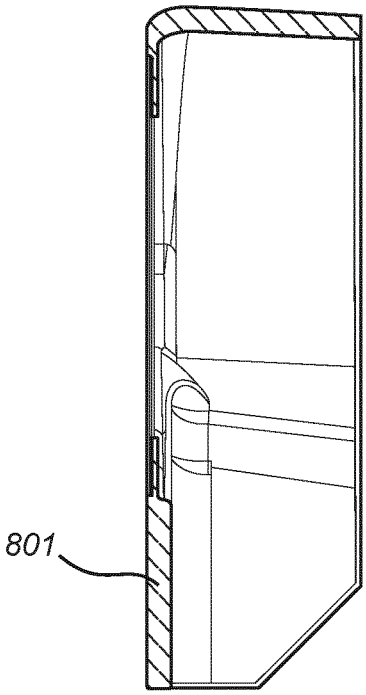
FIG. 10 is a cross-section view of the wear resistant cap of FIG. 8 along cross-section A-A of FIG. 8.
Figure 11:
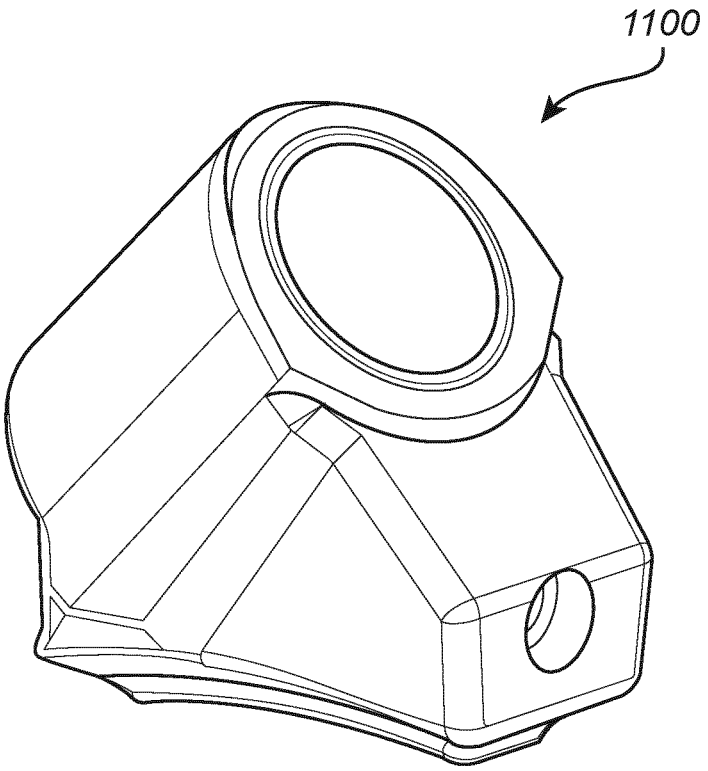
FIG. 11 is perspective view of a bit holder in accordance with one embodiment of the present application.

Referring to FIGS. 8, 9 and 10, a wear resistant cap 800 according to a further embodiment of the present application is shown in top view, side elevation view and cross-section view along cross-section, respectively. It is designed for a second type of bit holder 1100 as shown in FIG. 11, wherein the bit holder has a substantial cylindrical bit receptacle, while the bit receptacle wall is slightly tapered in a direction away from the top surface. The bit holder 1100 differs from that of FIG. 4 in that the top panel has a front portion 801 extending farther forward in relation to the center of the bore. Such front portion may be tapered inwardly as it extends toward the forward edge of the top surface, the front portion is a generally flat. The bit holder 1100 also differs from that of FIG. 4 in that the bit receptacle wall is slightly tapered in a direction away from the top surface rather than tapered in a direction towards the top surface as in FIG. 4.

To adapt to the shape of the bit holder 1100, the wear resistant cap 800 also has, at the rearward and at the left side and at the right side, a slightly inwardly tapered side wall in a direction away from the top panel. In addition, the front portion 801 of the top panel has enlarged extension along axis x in relation to the design of FIGS. 1 to 3. This allows that the top panel covers at least a part of a base portion of the bit holder. The front portion 801 of the top panel is flat and may have enlarged thickness.

Figure 12:
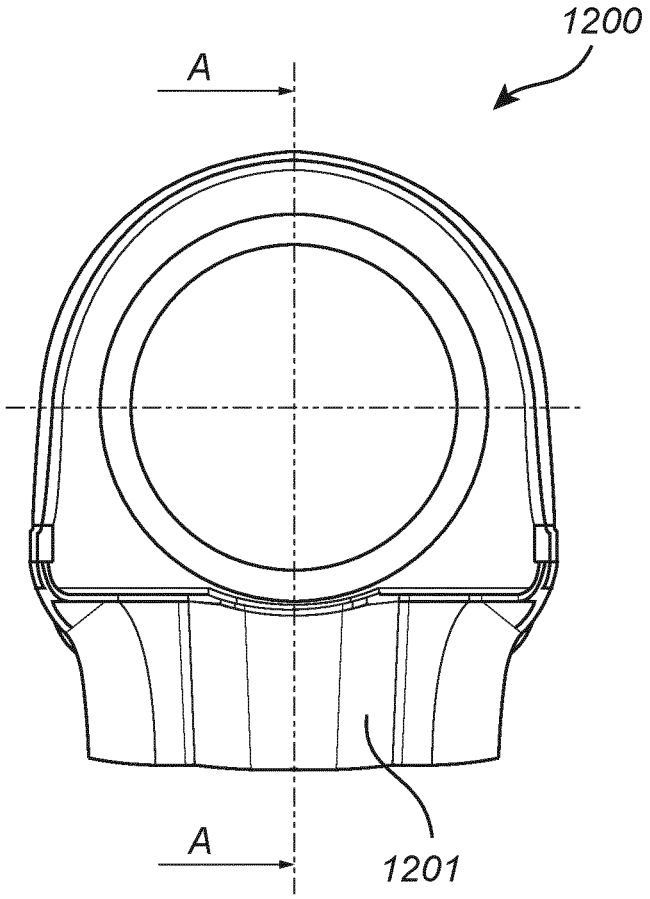
FIG. 12 is a top view of a wear resistant cap, according to a specific implementation of the present application.
Figure 13:
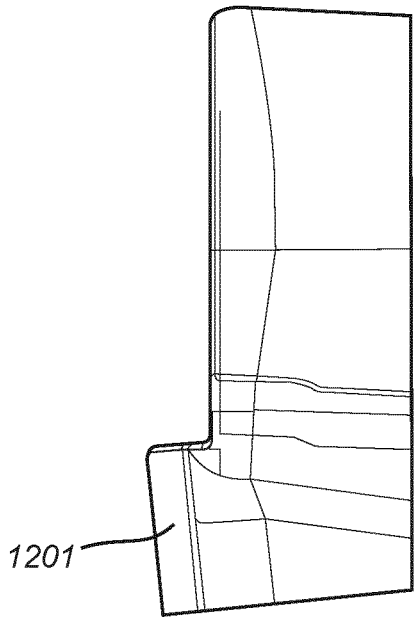
FIG. 13 is a side elevation view of the wear resistant cap of FIG. 12.
Figure 14:
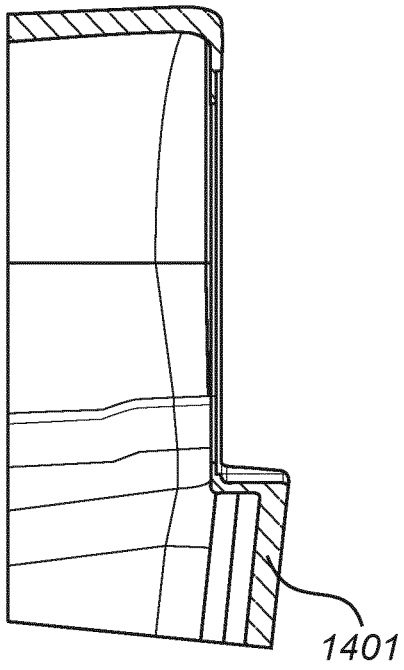
FIG. 14 is a cross-section view of the wear resistant cap of FIG. 12 along cross-section A-A of FIG. 12.
Figure 15:
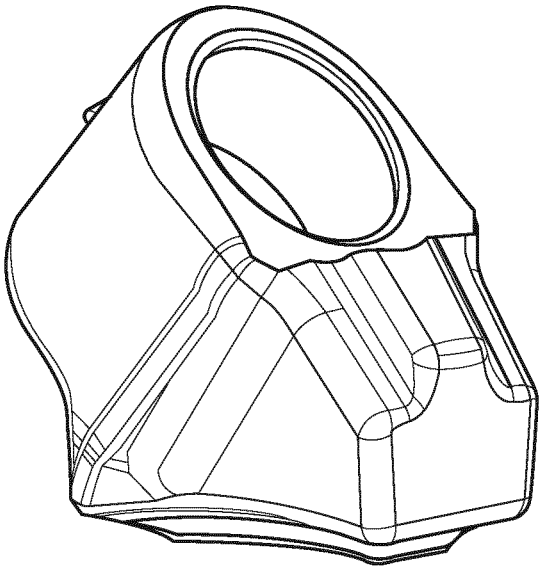
FIG. 15 is perspective view of a bit holder in accordance with one embodiment of the present application.
Figure 16:
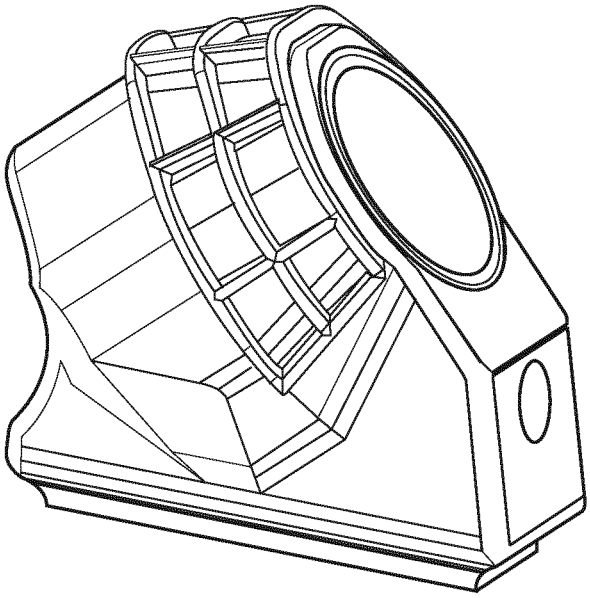
FIG. 16 shows an existing design of bit holder having wear segments.

Referring to FIGS. 12, 13 and 14, a wear resistant cap 1200 according to a further embodiment of the present application is shown in top view, side elevation view and cross-section view along cross-section, respectively. It is designed for a third type of bit holder as shown in FIG. 15, wherein the bit holder has a substantial cylindrical bit receptacle, while the bit receptacle wall is slightly tapered in a direction away from the top surface. The bit holder has a front portion 1201 extending farther forward, like the design of FIG. 11. Such front portion may be tapered inwardly as it extends toward the forward edge of the top surface, the front portion includes a central protrusion 1401 in relation to the rear portion of the top surface.

To adapt to the shape of the bit holder, the wear resistant cap also has, at the rearward and at the left side and at the right side, a slightly inwardly tapered side wall in a direction away from the top panel. In addition, the front portion 1201 has a convex shape like a saddle in relation to the design of FIGS. 8 to 10, there are arising transitional portions leading the top panel into a ridge 1401. This allows the top panel to conform to the shape of the bit holder and covers at least a part of a base portion of the bit holder.

The invention claimed is:

1. A wear resistant cap that is securable to a surface of a bit holder, wherein the bit holder is configured to receive a cutting tool, the wear resistant cap comprising:

a top panel; and a side panel connected to the top panel, wherein the top panel is configured to cover a top surface of the bit holder, the top panel including a peripheral section enclosing an opening that is configured to receive the cutting tool, and wherein the side panel includes at least one side wall connected to the outer edge of the top panel, and configured to cover at least a portion of a side surface of the bit holder, the top panel including a forward extending portion having a forward extension and a rearward extending portion having a rearward extension, the extensions being defined as a length measured from an inner edge of the peripheral section or a centre of the opening to a forward or rearward edge of the top panel, wherein the forward extension or together with an extension of a side wall at the front, is larger than the rearward extension, the extension of the side wall being defined as a length measured from the top edge to bottom edge of the side wall.

2. The wear resistant cap as claimed in claim 1, wherein the top panel includes a front portion extending forward beyond the peripheral section, in a generally rectangular or U form with an inner starting edge in an arc form joining the peripheral section.

3. The wear resistant cap as claimed in claim 2, wherein the front portion includes a protrusion in relation to the rear portion of the top panel.

4. The wear resistant cap as claimed in claim 1, wherein the forward extension, or together with an extension of a side wall at the front, is at least twice as large as the rearward extension.

5. The wear resistant cap as claimed in claim 1, wherein the side wall at the rearward is tapered inwardly or outwardly in a direction towards the top panel.

6. The wear resistant cap as claimed in claim 1, wherein the peripheral section has a thickness smaller than a thickness of the rest of the top panel.

7. The wear resistant cap as claimed in claim 1, wherein at least a part of the side panel has an enlarged thickness than the rest of the wear resistant cap.

8. The wear resistant cap as claimed in claim 1, wherein at least a part of the side panel includes bulging ribs, preferably arranged in a grid form.

9. The wear resistant cap as claimed in claim 1, wherein the top panel and the side panel are formed as one integral part, and wherein the peripheral section includes a closed circumferential ring starting in a radius direction from the opening.

10. The wear resistant cap as claimed in claim 1, further comprising a transitional segment situated between the top panel and the side panel, the transitional segment leading from the top panel into the side panel.

11. The wear resistant cap as claimed in claim 1, wherein the side panel extends to a desired length corresponding to a permissible wear distance, wherein the desired length is not less than a radius of the opening.

12. A bit holder arrangement for supporting a cutting tool, the bit holder arrangement being securable on a cutter drum of an underground mining machine, the bit holder arrangement comprising:

a bit holder including a base portion and a bit mounting portion located above the base portion;

wherein the base portion includes a bottom surface that is configured to be fastenable on the cutter drum, wherein the bit mounting portion includes a bore for receiving the cutting tool, wherein the central axial axis of the bore tilts forward and/or forms an acute angle in relation to the bottom surface, wherein the bit holder includes a top surface from which the bore extends, and a side surface that extends between the bottom surface and the top surface; and a wear resistant cap according to claim 1, the wear resistant cap being attachable to the bit holder, the wear resistant cap being configured to cover the top surface and at least a part of the side surface.

13. The bit holder arrangement as claimed in claim 12, wherein the wear resistant cap is releasably attached to the bit holder by an adhesive material.

* * * * *